US011034144B2

(12) United States Patent
Lin

(10) Patent No.: US 11,034,144 B2
(45) Date of Patent: Jun. 15, 2021

(54) INK BOX PROOFED AGAINST AIR BLOCKAGES

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventor: Kao-Hung Lin, New Taipei (TW)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 266 days.

(21) Appl. No.: 16/201,987

(22) Filed: Nov. 27, 2018

(65) Prior Publication Data

US 2020/0070497 A1 Mar. 5, 2020

(30) Foreign Application Priority Data

Aug. 31, 2018 (CN) ..... 201811015329.X

(51) Int. Cl.
*B41F 31/02* (2006.01)
*B41J 2/175* (2006.01)

(52) U.S. Cl.
CPC ..... *B41F 31/02* (2013.01); *B41J 2/17553* (2013.01)

(58) Field of Classification Search
CPC ..... B41J 2/17506; B41J 2/17553
See application file for complete search history.

(56) References Cited

U.S. PATENT DOCUMENTS 7,980,686 B2 * 7/2011 Guhse ..... B41J 2/17553 347/86

* cited by examiner

*Primary Examiner* — Leslie J Evanisko
*Assistant Examiner* — Leo T Hinze
(74) *Attorney, Agent, or Firm* — ScienBiziP, P.C.

(57) ABSTRACT

A refillable ink box proofed against the formation of airlocks during filling includes an ink storage chamber, a seat, and an insertion tube. The box includes a bottom plate, and first and second side walls. The bottom plate and first and second side walls form the ink storage chamber. The seat protrudes to the exterior and carries insertion tube, ink outlet, and air guiding port. The insertion tube defines the ink inlet and also an air vent. The ink inlet communicates with the ink outlet port, the ink outlet communicates with the ink storage chamber. The air guiding port equalizes gas pressure with outside atmosphere and is positioned above the ink outlet.

16 Claims, 7 Drawing Sheets

INK BOX PROOFED AGAINST AIR BLOCKAGES

FIELD

The subject matter herein generally relates to liquid transmission devices.

BACKGROUND

Ink filling devices include an ink bottle and an ink box. The ink box generally includes an insertion tube. The top end of the insertion tube defines an air channel and an ink channel. When the ink bottle is inverted into the insertion tube, ink in the ink bottle is automatically injected by gravity into the ink box. Although the ink filling device can inject the ink into the ink box, when an airlock is generated in the ink channel, the ink refill will stop.

Therefore, there is room for improvement within the art.

BRIEF DESCRIPTION OF THE DRAWINGS

Implementations of the present technology will now be described, by way of embodiments, with reference to the attached figures.

DETAILED DESCRIPTION

Figure 1:
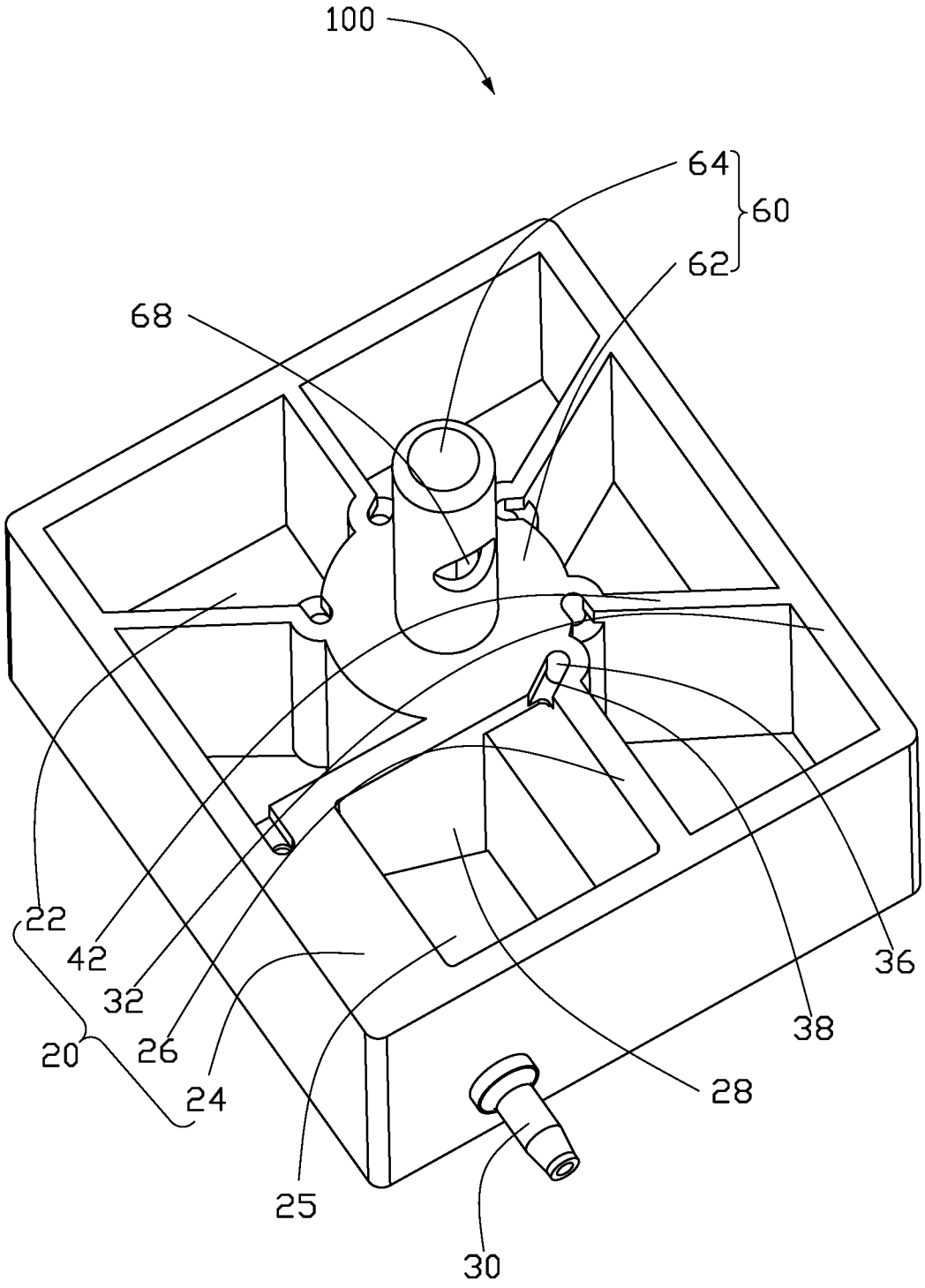
FIG. 1 is an isometric view of an ink box.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain parts may be exaggerated to better show details and features of the present disclosure. The disclosure is by way of example and not by way of limitation. In the figures of the accompanying drawings, like references indicate similar elements. It should be noted that references to "an" or "one" embodiment in this disclosure are not necessarily to the same embodiment, and such references mean "at least one."

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like. The references "a plurality of" and "a number of" mean "at least two."

FIGS. 1 to 5 shows an ink box 100. The ink box 100 includes an ink storage room 20 and an ink guiding member 60 fixed to the ink storage room 20. The ink guiding member 60 guides ink from an ink bottle 80 to the ink storage room 20.

The ink storage room 20 includes a bottom plate 22, a first side wall 24, and a second side wall 26 both fixed to the bottom plate 22. The second side wall 26 is connected to two ends of the first side wall 24. The bottom plate 22, the first side wall 24 and the second side wall 26 together form an ink storage chamber 28. An ink outlet tube 30 is fixed to an outer side of the first side wall 24 and communicates with the ink storage chamber 28. The ink guiding member 60 includes a seat 62 and a insertion tube 64 fixed to the seat 62. The seat 62 is fixed to the bottom plate 22 and protrudes from the outer side of the first side wall 24. The insertion tube 64 accepts the insertion of the ink bottle 80. A side of the insertion tube 64 forms an ink inlet 66 and an air vent 68. The ink inlet 66 is located above the air vent 68. The ink inlet 66 is at predetermined distance at least from an end of the tube away from the seat 62. The predetermined distance can be thirty centimeters. An ink outlet 70 and an air guiding port 72 are formed on the seat 62. The ink inlet 66 communicates with the ink outlet 70. The ink outlet 70 communicates with the ink storage chamber 28. The air guiding port 72 communicates with the air vent 68 and outside atmosphere. The air guiding port 72 is positioned above the ink outlet 70. A distance between the air guiding port 72 and the insertion tube is closer than a distance between the ink outlet 70 and the insertion tube 64.

The ink bottle 80 defines a receiving hole 82 and a receiving chamber 84 communicating with the receiving hole 82. A valve 88 is fixed at a communication port 86 connecting the receiving hole 82 and the receiving chamber 84 and movable along an axial direction of the receiving hole 82 for opening or closing the communication port 86.

When the ink bottle 80 is positioned over the insertion tube 64 and the receiving hole 82 is aligned with the insertion tube 64, the end of the insertion tube 64 away from the seat 62 abuts the valve 88 to drive the valve 88 away from communication port 86 to open the communication port 86. The end of the insertion tube 64 away from the base 62 is positioned in the receiving chamber 84 to reduce air space in the receiving chamber 84. Thus, an air pressure in the receiving chamber 84 is increased, so that the air pressure in the receiving chamber 84 is greater than an air pressure of the outside atmosphere. Since the ink inlet 66 is located above the air vent 68, during the insertion of the ink bottle 80 to the insertion tube 64, the receiving chamber 84 first communicates with the ink inlet 66 and then communicates with the air vent 68.

Figure 5:
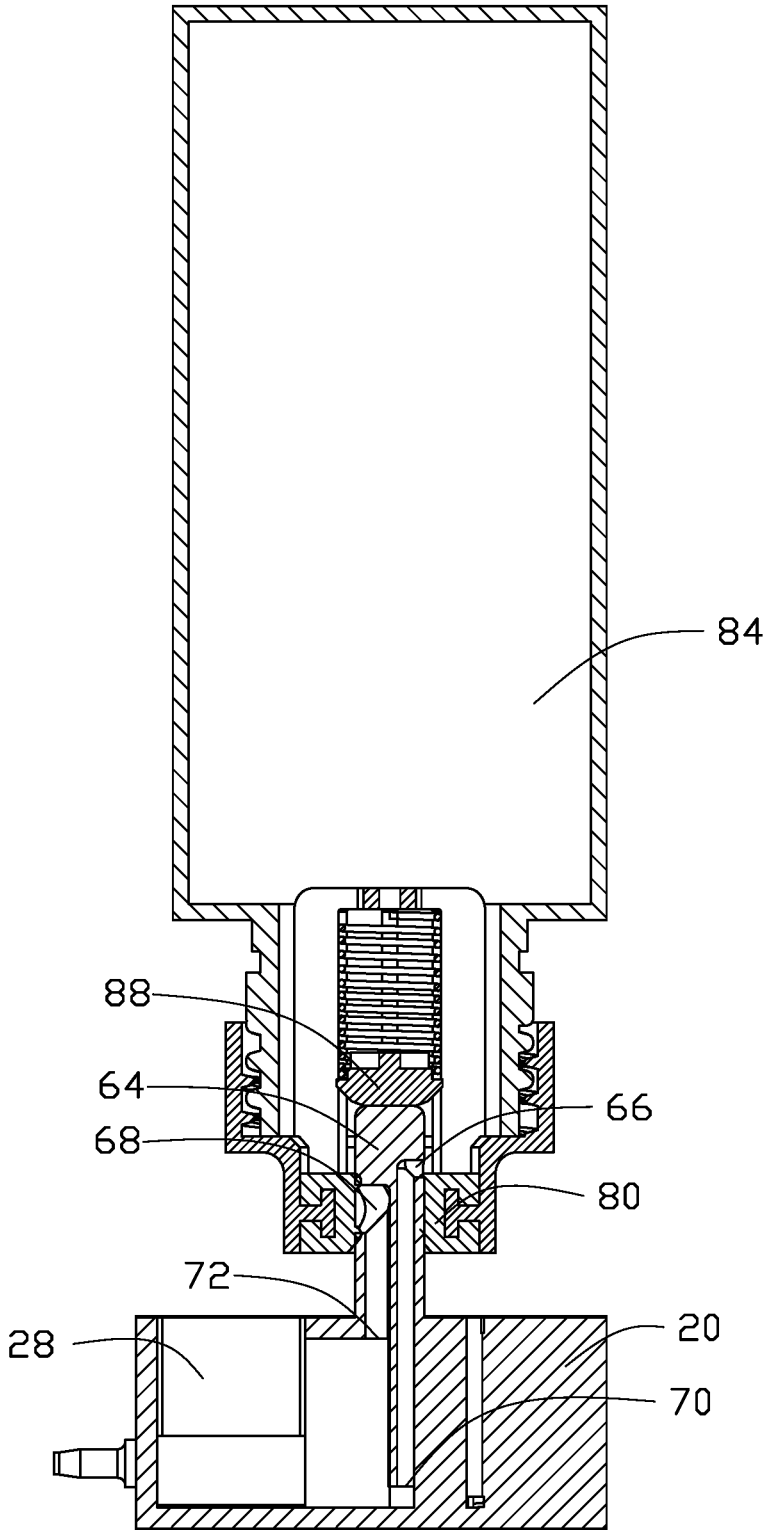
FIG. 5 is similar to FIG. 1, but with an ink storage chamber communicating with an ink inlet but not with an air vent.

Referring to FIG. 5, when the ink bottle 80 is inserted into the receiving chamber 84 and communicates with the ink inlet port 66 but does not communicate with the air vent 68, the air pressure in the receiving chamber 84 is greater than that of the outside atmosphere. Thus the ink in the receiving chamber 84 and the air and any debris between the ink inlet 66 and the ink outlet 70 will flow out from the ink outlet 70 and avoid the formation of airlock between the ink inlet port 66 and the ink outlet 70. In addition, even if the ink bottle 80 has an airlock between the ink inlet port 66 and the ink outlet port 70 before being inserted into the insertion tube 64, the air pressure in the receiving chamber 84 will remove airlock generated between the ink inlet 66 and the ink outlet 70. The ink thus flows to the ink inlet 66 and flows out from the ink outlet 70.

Figure 2:
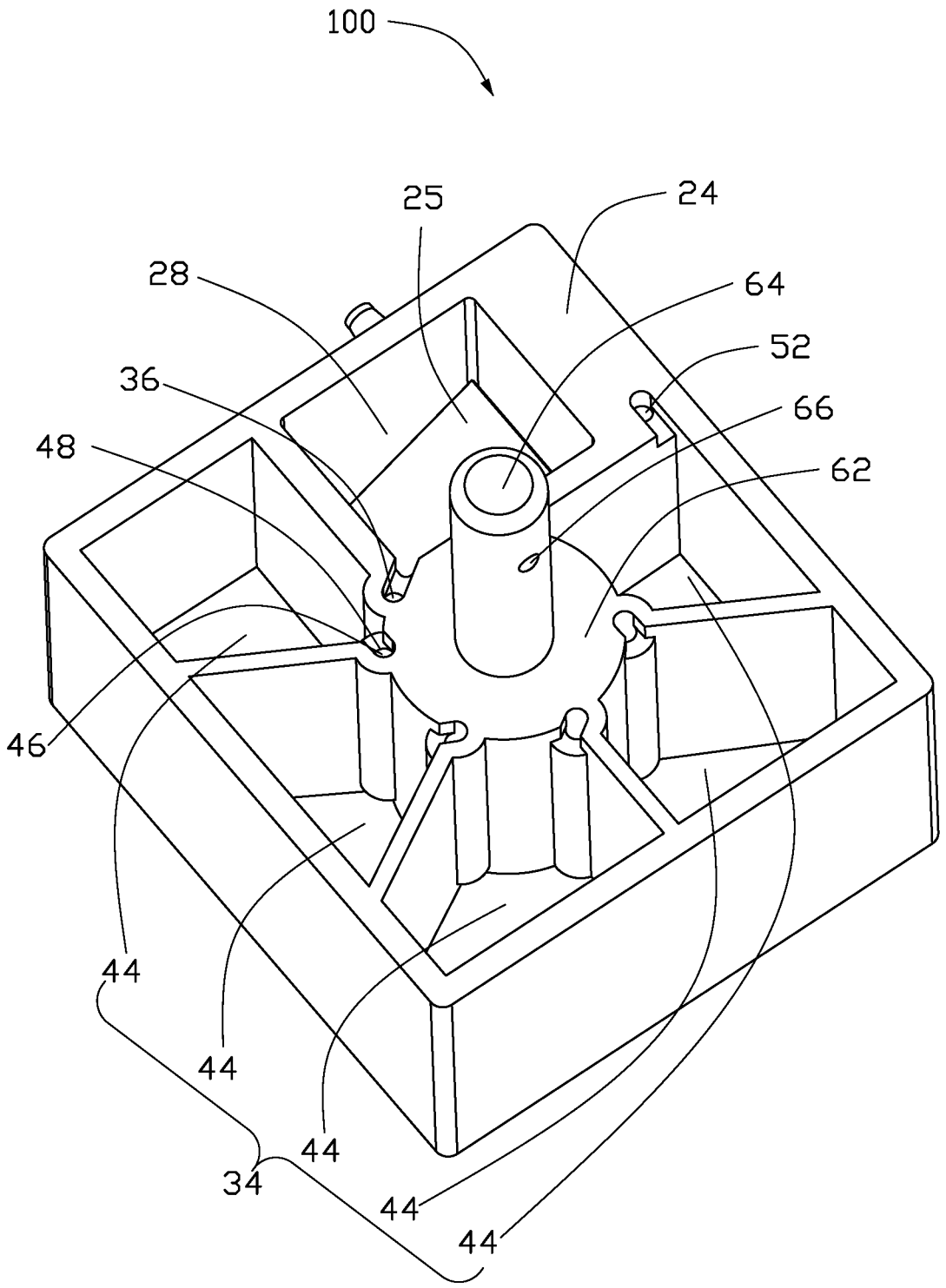
FIG. 2 is similar to FIG. 1, but viewed from a different viewpoint.
Figure 3:
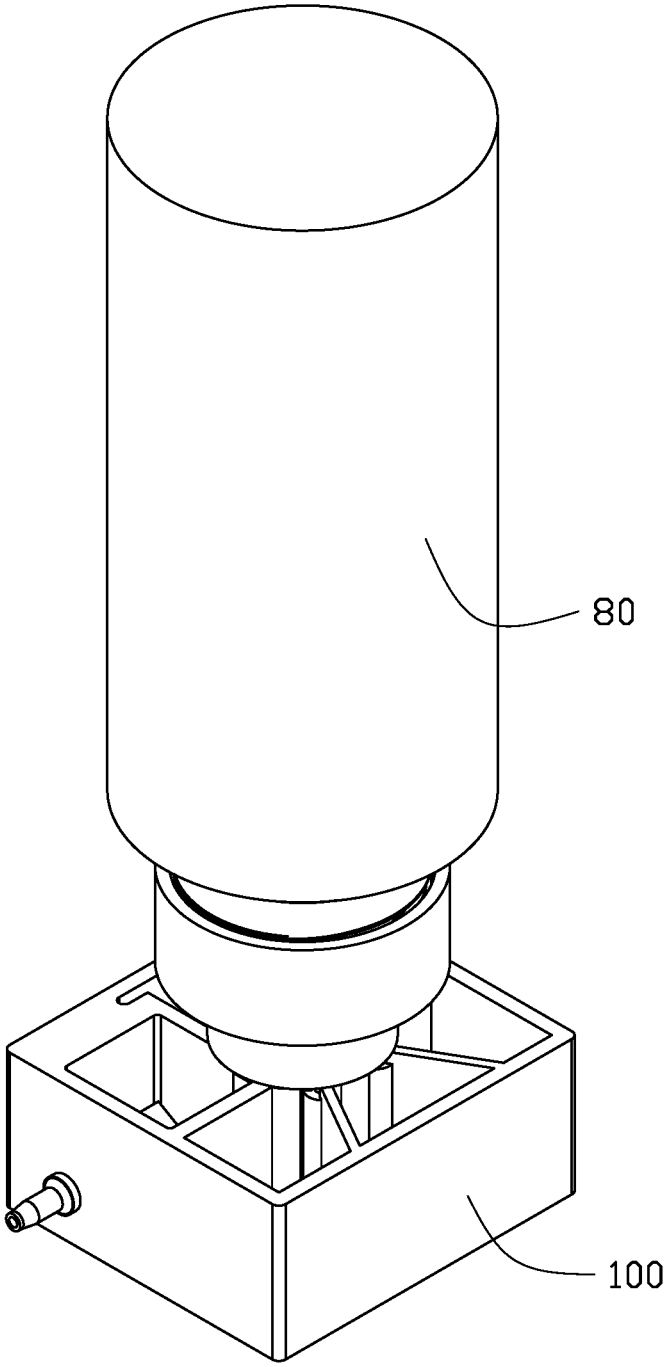
FIG. 3 is an isometric view of the ink box in FIG. 1 with an ink bottle.
Figure 4:
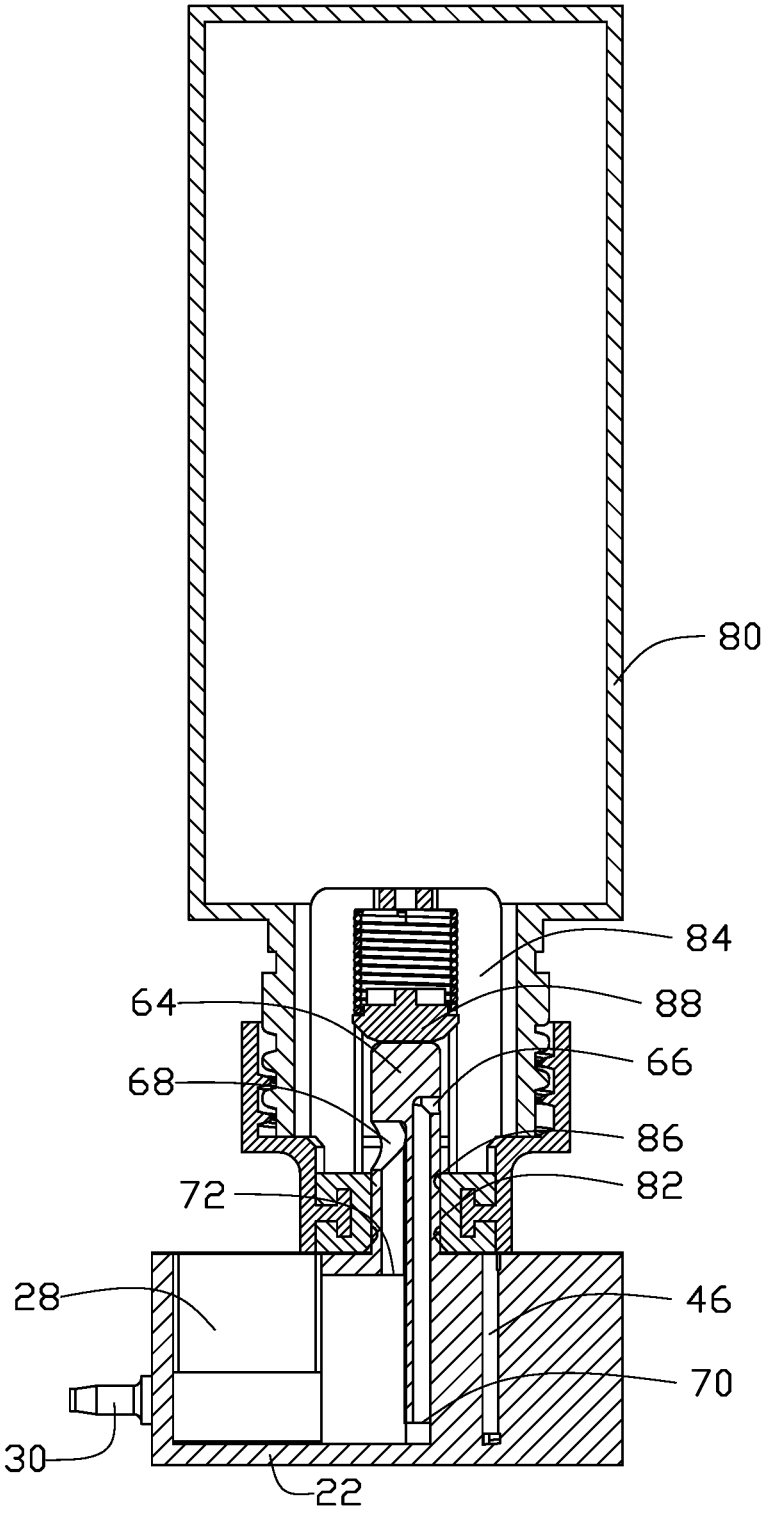
FIG. 4 is a cross-sectional view of the ink box with the ink bottle in FIG. 3.

Referring to FIG. 4, when the ink bottle 80 is inserted into the receiving chamber 84 to communicate with the vent 68, the ink outlet 70 being below the air vent 68 allows the ink to flow from the ink outlet 70 to the ink storage chamber 28. The outside air can flow to the ink bottle 80 through the air guiding port 72 and the air vent 68, so that the ink continues to flow to the ink storage chamber 28 and then flow out of the ink outlet tube 30. Referring to FIG. 1 and FIG. 2, a filter 25 is fixed in the ink storage chamber 28. When the ink flows into the ink storage chamber 28, the ink is filtered by the filter 25 before going to the bottom of the ink storage chamber 28 and flowing out of the ink outlet tube 30.

The ink storage room 20 further includes a third side wall 32 fixed to the bottom plate 22, the first side wall 24, and the second side wall 26, forming a receiving cavity 34. The second side wall 26 defines a first ink channel 36. The first ink channel 36 includes a first inlet 38 and a first outlet 40 communicating with the first inlet 38. A distance between the first inlet 38 and the bottom plate 22 is greater than a distance between the first outlet 40 and the bottom plate 22. The first inlet 38 can be positioned at an upper portion of the second side wall 26, and the first outlet 40 can be positioned at a lower portion of the second side wall 26. The first inlet 38 communicates with the ink storage chamber 28, and the first outlet 40 communicates with the receiving cavity 34. When the ink in the ink storage room 20 is located at the first inlet 38, the first ink channel 36 guides ink into the receiving cavity 34 to prevent ink overflowing in the ink storage room 20.

Figure 6:
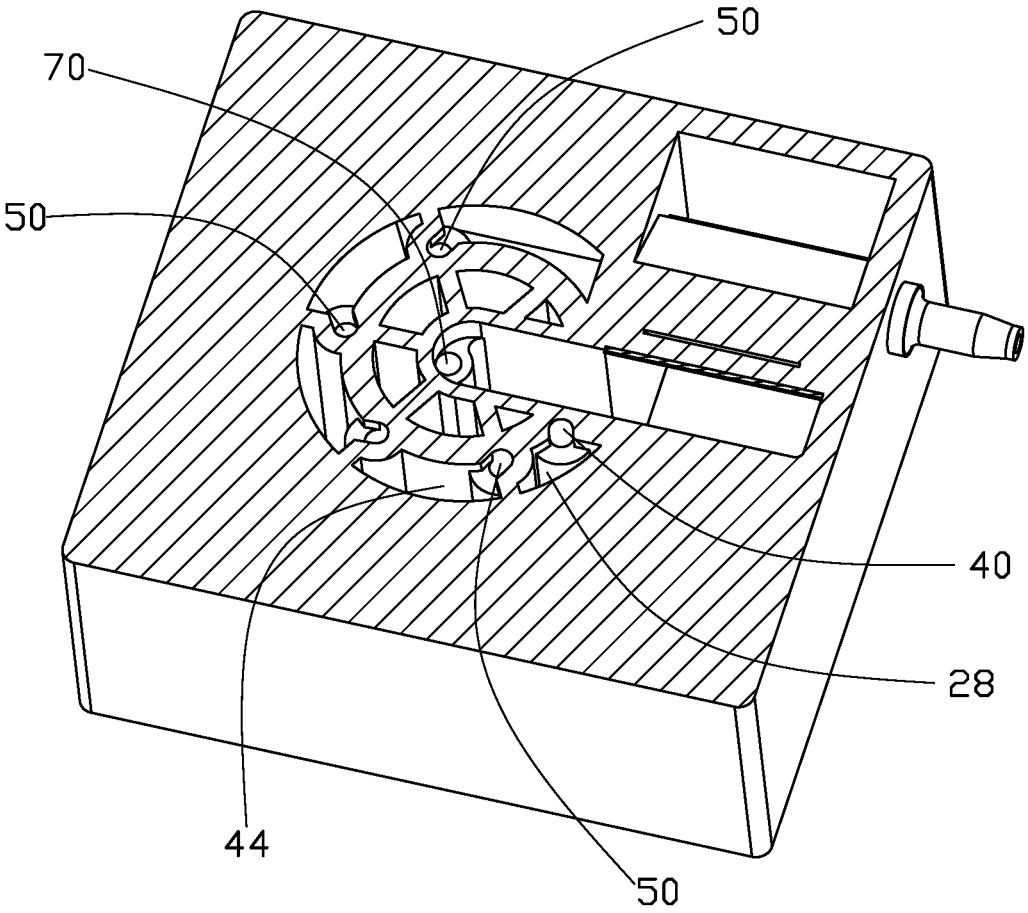
FIG. 6 is a cross-sectional view of an intersection of a bottom plate of ink box in FIG. 1 and an ink storage chamber.

The ink storage chamber 20 further includes at least one fourth side wall 42 extending from an inner side of the third side wall 32 to the seat 62. The at least one fourth side wall 42 divides the receiving cavity 34 into a number of adjacent accommodating regions 44. The accommodating regions 44 communicate with each other. In the embodiment, the ink box 100 includes four fourth side walls 42, and the four fourth sidewalls 42 divide the receiving cavity 34 into five accommodating regions 44. Referring to FIGS. 2 and 6, each of the fourth side walls 42 defines a second ink channel 46. Each of the second ink channels 46 includes a second inlet 48 and a second outlet 50 communicating with the second inlet 48. Each of the second inlets 48 communicates with one of the accommodating regions 44, and each of the second outlets 50 communicates with an adjacent accommodating region 44. When the ink in one of the accommodating regions 44 is located at the second inlet 48, the second ink channel 46 guides the ink into an adjacent one of the accommodating regions 44 to prevent the ink overflowing.

Figure 7:
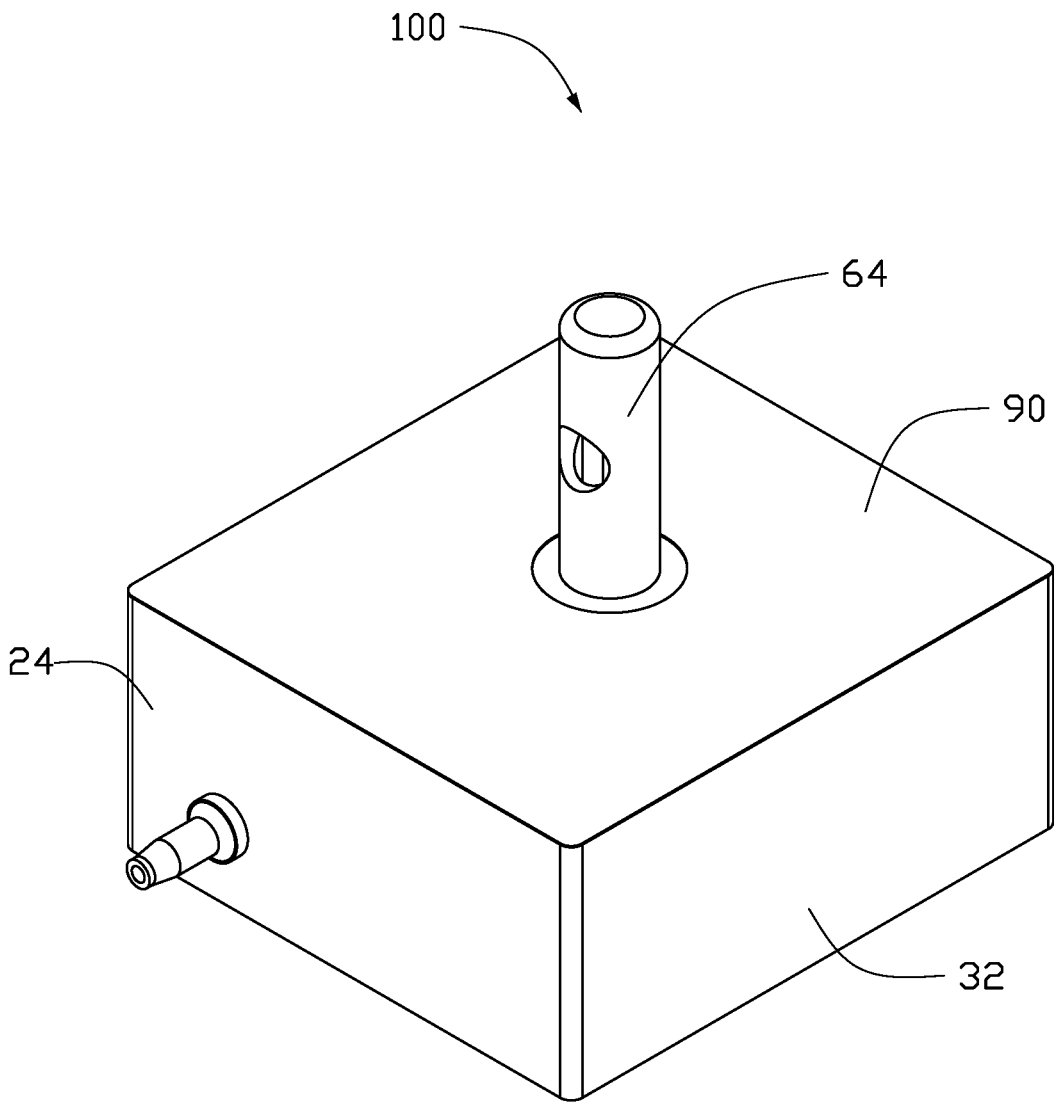
FIG. 7 is an isometric view of the ink box in FIG. 1 with a sealing member.

Referring to FIG. 7, the ink box 100 further includes a sealing member 90. The sealing member 90 is fixed on end surfaces of the first side wall 24, the second side wall 26, the third side wall 32, and the fourth side wall 42 away from the bottom plate 22. The sealing member 90 can be a heat-pressed thin film fixed to the end surfaces. An end of the first side wall 24 away from the bottom plate 22 defines a through hole 52. The outside atmosphere can flow into the receiving cavity 34 and the ink storage chamber 28 through the through hole 52 to enter to the air guiding port 72.

The embodiments shown and described above are only examples. Therefore, many commonly-known features and details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An ink box comprising:

an ink storage room comprising a bottom plate, a first side wall and a second side wall; the first side wall and the second side wall both fixed to the bottom plate, the second side wall connected to two ends of the first side wall; the bottom plate, the first side wall and the second side wall together forming an ink storage chamber;

a seat fixed to the bottom plate and protruding from an outside of the first side wall, the seat defining an ink outlet and an air guiding port;

an insertion tube fixed to the seat and used for inserting an ink bottle, a side of the insertion tube forming an ink inlet and an air vent, the ink inlet being located above the air vent and at least a predetermined distance from an end of the insertion tube away from the seat, the ink inlet communicating with the ink outlet port, the ink outlet communicating with the ink storage chamber, the air guiding port communicating with the air vent and outside atmosphere, the air guiding port positioned above the ink outlet; and a third side wall fixed to the bottom plate, and fixed to the first side wall and the second side wall to form a receiving cavity;

wherein the second side wall defines a first ink channel, the first ink channel comprises a first inlet and a first outlet communicating with the first inlet, a distance between the first inlet and the bottom plate is greater than a distance between the first outlet and the bottom plate, the first inlet communicates with the ink storage chamber, and the first outlet communicates with the receiving cavity such that when the ink in the ink storage room is located at the first inlet, the first ink channel guides ink into the receiving cavity, and at least one fourth side wall extending from an inner side of the third side wall to the seat, the at least one fourth side wall dividing the receiving cavity into a number of adjacent accommodating regions, the accommodating areas communicating with each other.

2. The ink box of claim 1, wherein an ink outlet tube is fixed to an outer side of the first side wall and communicates with the ink storage chamber.

3. The ink box of claim 1, wherein the predetermined distance is thirty centimeters.

4. The ink box of claim 1, wherein the ink box comprises four fourth side walls, and the four fourth sidewalls divide the receiving cavity into five accommodating regions.

5. The ink box of claim 4, further comprising:

a sealing member fixed on end surfaces of the first side wall, the second side wall, the third side wall and the fourth side wall away from the bottom plate.

6. The ink box of claim 5, wherein the sealing member is a heat-pressed thin film fixed to the end surfaces.

7. The ink box of claim 5, wherein an end of the first side wall away from the bottom plate defines a through hole, the outside atmosphere flows into the receiving cavity and the ink storage chamber through the through hole to enter to the air guiding port.

8. The ink box of claim 1, wherein each fourth side walls define a second ink channel, each second ink channel comprises a second inlet and a second outlet communicating with the second inlet, each second inlet communicates with one of the accommodating regions, and each second outlet communicates with another adjacent accommodating region.

9. An ink box comprising:

an ink storage room comprising a bottom plate, a first side wall and a second side wall; the first side wall and the second side wall both fixed to the bottom plate to form an ink storage chamber;

a seat connected to the bottom plate and protruding from an outside of the first side wall, the seat defining an ink outlet and an air guiding port;

an insertion tube connected to the seat and used for inserting an ink bottle, the insertion tube defining an ink inlet and an air vent, the ink inlet being located above the air vent and a predetermined distance from an end of the insertion tube away from the seat, the ink inlet communicating with the ink outlet port, the ink outlet communicating with the ink storage chamber, the air guiding port communicating with the air vent and outside atmosphere, a distance between the air guiding port and the insertion tube being closer than a distance between the ink outlet and the insertion tube; and a third side wall fixed to the bottom plate, and fixed to the first side wall and the second side wall to form a receiving cavity;

wherein the second side wall defines a first ink channel, the first ink channel comprises a first inlet and a first outlet communicating with the first inlet, a distance between the first inlet and the bottom plate is greater than a distance between the first outlet and the bottom plate, the first inlet communicates with the ink storage chamber, and the first outlet communicates with the receiving cavity, such that when the ink in the ink storage room is located at the first inlet, the first ink channel guides ink into the receiving cavity, and at least one fourth side wall extending from an inner side of the third side wall to the seat, the at least one fourth side wall dividing the receiving cavity into a number of adjacent accommodating regions, the accommodating areas communicating with each other.

10. The ink box of claim 9, wherein an ink outlet tube is fixed to an outer side of the first side wall and communicates with the ink storage chamber.

11. The ink box of claim 9, wherein the predetermined distance is thirty centimeters.

12. The ink box of claim 9, wherein the ink box comprises four fourth side walls, and the four fourth sidewalls divide the receiving cavity into five accommodating regions.

13. The ink box of claim 12, further comprising:

a sealing member fixed on end surfaces of the first side wall, the second side wall, the third side wall and the fourth side wall away from the bottom plate.

14. The ink box of claim 13, wherein the sealing member is a heat-pressed thin film fixed to the end surfaces.

15. The ink box of claim 13, wherein an end of the first side wall away from the bottom plate defines a through hole, the outside atmosphere flows into the receiving cavity and the ink storage chamber through the through hole to enter to the air guiding port.

16. The ink box of claim 9, wherein each fourth side wall defines a second ink channel, each the second ink channel comprises a second inlet and a second outlet communicating with the second inlet, each second inlet communicates with one of the accommodating regions, and each second outlet communicates with another adjacent accommodating region.

* * * * *